US011111103B2

(12) United States Patent
Weibel et al.

(10) Patent No.: US 11,111,103 B2
(45) Date of Patent: Sep. 7, 2021

(54) ROPE SWAY REDUCING ARRANGEMENT FOR WEIGHT BASED HINDERING OF LATERAL SWAY OF AN ELONGATE ROPE-LIKE MEANS IN AN ELEVATOR HOISTWAY

(71) Applicant: Inventio AG, Hergiswil (CH)

(72) Inventors: André Weibel, Ballwil (CH); Matt Martin, Randolph, NJ (US)

(73) Assignee: INVENTIO AG, Hergiswil NW (CH)

( * ) Notice: Subject to any disclaimer, the term of this patent is extended or adjusted under 35 U.S.C. 154(b) by 680 days.

(21) Appl. No.: 15/763,207

(22) PCT Filed: Sep. 29, 2016

(86) PCT No.: PCT/EP2016/073172

§ 371 (c)(1),
(2) Date: Mar. 26, 2018

(87) PCT Pub. No.: WO2017/055390

PCT Pub. Date: Apr. 6, 2017

(65) Prior Publication Data

US 2018/0282126 A1 Oct. 4, 2018

(30) Foreign Application Priority Data

Sep. 30, 2015 (EP) ..... 15187695

(51) Int. Cl.
*B66B 7/06* (2006.01)
*B66B 9/00* (2006.01)

(52) U.S. Cl.
CPC ..... *B66B 7/068* (2013.01); *B66B 7/06* (2013.01); *B66B 9/00* (2013.01); *B66B 7/064* (2013.01)

(58) Field of Classification Search
CPC ..... B66B 7/064
See application file for complete search history.

(56) References Cited

U.S. PATENT DOCUMENTS

2016/0207738 A1* 7/2016 Altenburger ..... B66B 11/026

FOREIGN PATENT DOCUMENTS

CN 107758475 A * 3/2018
EP 2765110 A2 8/2014
(Continued)

OTHER PUBLICATIONS

English Machine Translation of JPS 49066147.*
Machine Translation of JP 2007-153588.*

*Primary Examiner* — Diem M Tran
(74) *Attorney, Agent, or Firm* — William J. Clemens; Shumaker, Loop & Kendrick, LLP

(57) ABSTRACT

A rope sway reducing arrangement hinders a lateral sway of an elongate rope-like device having one end attached to a movable component displaceable within an elevator hoistway and another end attached to a fixed position within the hoistway. The sway reducing arrangement includes an elongate guide arrangement having two spanning ropes fixedly attached within and extending in a longitudinal direction of the hoistway. The sway reducing arrangement further includes a rope tensioning arrangement having a weight member and being mechanically connected to the guide arrangement for displacement and guiding along the longitudinal direction of the guide arrangement. The mechanical connection is via an engagement member to generate tensioning forces onto the rope-like device due to gravity-induced forces resulting from a weight of the weight member. Thereby, the rope-like device is held at the guide arrangement with a downward directed mechanical tension thereby preventing excessive lateral sway.

15 Claims, 2 Drawing Sheets

(56) References Cited

FOREIGN PATENT DOCUMENTS

| | | | | |
|---|---|---|---|---|
| JP | 34966147 | U | | 6/1974 |
| JP | H028183 | A | | 1/1990 |
| JP | 06278968 | A | * | 10/1994 |
| JP | 109151059 | A | | 6/1997 |
| JP | 2007153588 | A | | 6/2007 |
| WO | 2004028948 | A1 | | 4/2004 |
| WO | 2011117458 | A1 | | 9/2011 |

* cited by examiner

ROPE SWAY REDUCING ARRANGEMENT FOR WEIGHT BASED HINDERING OF LATERAL SWAY OF AN ELONGATE ROPE-LIKE MEANS IN AN ELEVATOR HOISTWAY

FIELD

The present invention relates to an elevator system comprising a loose rope-like means. Particularly, the present invention relates to a rope sway reducing arrangement for hindering a lateral sway of such elongate rope-like means in an elevator hoistway.

BACKGROUND

Elevators are generally used for transporting passengers and/or goods within a building, typically in a vertical direction. Therein, a movable component such as an elevator car or a counterweight is displaced within a hoistway. Typically, the car and/or the counterweight are suspended by a suspension traction means (STM) such as one or more ropes or belts which may be driven by a driving means such as an electric engine driving a traction sheave.

Additionally to the suspension traction means which has to carry the weight of the movable components and is therefore generally tense, the elevator system may comprise additional rope-like means which typically do not have to carry substantial weight, except for their own weight. Such additional rope-like means may be used for example for supplying electric energy to the movable elevator car and/or for transmitting signals between the movable elevator car and for example a component such as an elevator control being fixedly installed within the building comprising the elevator hoistway. Generally, one end of such rope-like means is attached to the movable component whereas the other end of the rope-like means is attached to a fixed position within the hoistway.

As such additional rope-like means does not have to carry substantial loads, a portion of the rope-like means is generally hanging downwards from the movable component in a relatively loose manner. If not prevented by specific measures, such loose portion of the rope-like means may freely swing or sway within the elevator hoistway.

For example, high-rise buildings may sway during windy days such that the entire hoistway comprised in the building substantially sways thereby inducing swaying of the loose portion of the rope-like means. Alternatively or additionally, high-speed elevators used in high-rise buildings may generate air turbulences within the hoistway upon moving its movable components and such air turbulences may induce swaying of the loose portion of the rope-like means.

Lateral swaying of the loose portion of the rope-like means is generally undesirable as it may for example stress the rope-like means and/or may produce noise and vibrations or other discomfort to passengers of the elevator.

Various sway damping solutions have been presented. For example, WO 2011/117458 describes disposing a detachable damping means producing a mass effect to be supported by a top surface of a bottom loop of a rope-like means for damping lateral sways of the rope-like means. EP 2 765 110 A2 describes an arrangement for damping lateral sways of rope-like means fixed to an elevator unit, the arrangement comprising a freely hanging damping means supported on a top surface of a bottom loop of the rope-like means, the damping means comprising a device for measuring acceleration and/or twisting of the rope-like means.

There may be a need for an alternative approach for hindering a lateral sway of a rope-like means in an elevator hoistway. Particularly, there may be a need for an alternative rope sway reducing arrangement which may be implemented in a simple, reliable and/or cost-effective manner.

SUMMARY

According to a first aspect of the present invention, a rope sway reducing arrangement for hindering a lateral sway of an elongate rope-like means in an elevator hoistway is presented. Therein, one end of the rope-like means is attached to a movable component such as a car to be displaced within the hoistway and another end of the rope-like means is attached to a fixed position within the hoistway. The arrangement comprises an elongate guide arrangement fixedly attached within the hoistway and extending in a longitudinal direction of the hoistway. Furthermore, the arrangement comprises a rope tensioning arrangement comprising a weight member. The rope tensioning arrangement is mechanically connected to the guide arrangement such as to be displaceable along the longitudinal direction of the guide arrangement and to be guided by the guide arrangement. Therein, rope tensioning arrangement is mechanically connected to the rope-like means, and the rope tensioning arrangement is adapted and arranged such as to generate tensioning forces onto the rope-like means due to gravity-induced forces resulting from a weight of the weight member of the rope tensioning arrangement.

Without limiting the scope of the invention in any way, principles and features of embodiments of the present invention may be understood as being based on the following ideas and observations.

Generally and broadly spoken, it is proposed herein to reduce any swaying of a loose portion of an elongate rope-like means in the elevator hoistway by providing a specific rope sway reducing arrangement (hereinafter partly abbreviated as "RSR arrangement") which comprises a guide arrangement and a rope tensioning arrangement which interact in such manner such as to generate gravity-induced forces onto the loose portion of the rope-like means in a manner and direction such that this loose portion of the rope-like means is mechanically tensioned. Therein, the gravity-induced forces onto the loose portion of the rope-like means result from the heavy weight of the weight member forming part of the rope tensioning arrangement. Accordingly, due to such gravity-induced tensioning forces, lateral swaying of the loose portion of the rope-like means may significantly be hindered, i.e. a swaying distance covered by the swaying rope-like means may be significantly reduced, for example by at least 20%, 50% or even 80% when compared to a non-hindered lateral sway of the rope-like means.

According to an embodiment, the elongate guide arrangement comprises a spanning rope extending between a top portion and a bottom portion of the hoistway.

Therein, the spanning rope may be any rope-like member having no or only a minor flexibility in a longitudinal direction but may be significantly bent in directions perpendicular to its longitudinal direction. Generally, the spanning rope may be any quasi-one-dimensional member. For example, the spanning rope may comprise one or more wires, chords, strands, etc. The spanning rope may comprise or consist of e.g. metal wires such as steel wires and/or synthetic fibers such as carbon fibers, glass fibers, Kevlar fibers, etc. The spanning rope may be spanned linearly between the top portion and the bottom portion of the hoistway. For example, opposite ends of the spanning rope may be attached at opposite ends of the hoistway, i.e. at or close to a roof wall and a bottom wall, respectively, of the hoistway.

Such spanning rope may be easily inserted into the hoistway before installation thereof and may then easily be installed in the hoistway by spanning the spanning rope between two attachment fixtures arranged at opposite ends of the hoistway.

According to an embodiment, the rope tensioning arrangement comprises a ring member enclosing the spanning rope to thereby guide the rope tensioning arrangement along the longitudinal direction of the spanning rope.

Therein, the ring member may be any ring-like member enabling to enclose the spanning rope in its inner portion such that the spanning rope may not escape from the ring member. For example, the ring member may have a tubular or cylindrical geometry. By enclosing the spanning rope, the ring member and further parts of the rope tensioning arrangement mechanically connected to the ring member are guided by the spanning rope such that the ring member may be displaced in the longitudinal direction of the spanning rope but may not substantially be displaced in directions perpendicular thereto.

According to a specific embodiment, the rope tensioning arrangement comprises an engagement member mechanically connected to the ring member of the rope tensioning arrangement and adapted for engaging with the rope-like means in such manner such as to enable transmitting the tensioning forces onto the rope-like means.

In other words, while tensioning forces result from the weight of the weight member of the rope tensioning arrangement, the rope tensioning arrangement furthermore comprises an engagement member for engaging with the rope-like means to be tensioned such that the gravity-induced forces of the weight member may be transmitted via the engagement member to the rope-like means. The engagement member may interact with the rope-like means e.g. via a positive fit connection. Thereby, the rope-like means may be significantly tensioned in a downward direction due to the gravity-induces forces.

Further specifically in accordance with an embodiment, the engagement member is adapted to engage behind an upward directed surface of a lowermost portion of a U-shaped section of a loosely hanging portion of the rope-like means.

In other words, the engagement member of the rope tensioning arrangement may engage with a lowermost portion of the U-shaped section formed by the rope-like means upon being held at its one end at an upside fixed position and being held at another end at an upside movable position connected to the movable component of the elevator. The engagement member may then come into mechanical contact to an upwards directed surface of such U-shaped section and, by pushing down this surface due to the gravity-induced forces, may tension the rope-like means.

According to another embodiment, the guide arrangement comprises two spanning ropes extending in parallel to each other between a top portion and a bottom portion of the hoistway. Preferably a lowermost portion of a U-shaped section of a loosely hanging portion of the rope-like means passes between the two spanning ropes. Therefore the rope like means is prevented from swaying further than to each of the spanning ropes.

In other words, additionally to a first spanning rope as described above, a second spanning rope may be provided at a lateral distance to the first spanning rope and running preferably substantially parallel to the first spanning rope.

In such embodiment, the rope tensioning arrangement may comprise two ring members each enclosing one of the spanning ropes to thereby guide the rope tensioning means along a longitudinal direction parallel to the spanning ropes.

Furthermore, the rope tensioning arrangement may comprise an engagement member mechanically connected to both ring members of the rope tensioning arrangement and adapted for engaging with the rope-like means in such manner such as to enable transmitting the tensioning forces onto the rope-like means.

Particularly, the engagement member may be adapted to engage behind an upward directed surface of the lowermost portion of a U-shaped section of a loosely hanging portion of the rope-like means.

In the aforementioned embodiments, the engagement member may be formed by a rope-like connector between the two ring members.

In other words, while the two ring members of the rope tensioning arrangement each enclose one of the spanning ropes and are guided thereby in a substantially vertical direction, the two ring members may be connected with each other by a rope-like connector. Such rope-like connector may be adapted to transmit the gravity-induced forces generated by the weight member of the rope tensioning arrangement to the loosely hanging portion of the rope-like means in order to mechanically tension the rope-like means. Therein, the rope-like connector may span a distance between the two ring members, i.e. substantially a distance between the two parallel spanning ropes, and may engage behind a U-shaped section on the rope-like means.

According to an embodiment, one of the parallel spanning ropes extends along a first lateral side of the loosely hanging portion of the rope-like means and the other one of the parallel spanning ropes extends along a second side of the loosely hanging portion of the rope-like means opposite to the first lateral side.

In other words, the two spanning ropes extend at opposite sides with respect to a portion of the rope-like means being arranged in between these two spanning ropes. Accordingly, the spanning ropes may form a mechanical limit limiting a degree of freedom for the rope-like means being enclosed between the two spanning ropes. Accordingly, the rope-like means may not excessively sway within a plane being defined by the two spanning ropes.

According to an embodiment, the weight member has a weight of between 4 kg and 100 kg.

Therein, the weight member may be formed of a single element. However, it is more preferred to provide the weight member with two or more separate weight elements. For example, one weight element may be provided at each of two opposite sides of the rope-like means. Therein, each weight element may be mechanically attached to a ring member enclosing one of the spanning ropes such as to be guided along the spanning rope. Preferably, the weight member may be an integral portion of the ring member, i.e. the ring member may be provided with such heavy structure such as to serve as a weight member or one of its weight elements. The weight of the weight elements may result in gravity-induced forces which may be transmitted to an intermediately arranged rope-like means for example by a rope-like connector connecting the two ring members. In case the two weight elements have same weights, the resulting gravity-induced forces may be applied symmetrically to the rope-like means.

According to a further embodiment, the rope sway reducing arrangement further comprises a protection means for protecting the rope-like means against wear which wear may otherwise occur upon engagement of a portion of the rope tensioning arrangement with the rope-like means.

In other words, as the rope tensioning arrangement shall apply gravity-induced forces to the rope-like means, such application of substantial forces to the rope-like means may result in substantive wear for example due to unavoidable relative motions between the rope tensioning arrangement and the rope-like means during application of such substantial forces. In order to avoid such wear, a protection means for protecting the rope-like means may be provided.

For example, such protection means may be a protective cover, a jacket, a sheath or similar which has for example a smooth and/or soft surface such as to avoid, inter alia, any sharp edges and/or force concentrations upon transmitting the gravity-induced forces from the rope tensioning arrangement to the rope-like means. For example, the protection means may be arranged between a surface of the rope-like means and an engagement surface of the rope tensioning arrangement, preferably an engagement surface of the engagement member of the rope tensioning arrangement. The protection means may comprise or consist of a member with a wear-resistant material such as a metal member or a plastic member.

According to a second aspect of the present invention, an elevator system is proposed. Such elevator system comprises a movable component to be displaced within a hoistway, a rope-like means and a rope sway reducing arrangement according to an embodiment of the above-described first aspect of the invention.

In such elevator system, any swaying of the rope-like means being attached to the movable component at its one end and being attached to a fixed position within the hoistway at its other end may be effectively suppressed using the tensioning force-inducing effect provided by the rope sway reducing arrangement.

It shall be noticed that possible features and advantages of embodiments of the present invention are described herein partly with respect to a rope sway reducing arrangement and partly with respect to an elevator system comprising such RSR arrangement. One skilled in the art will recognize that the described features may be suitably transferred from one embodiment to another and features may be modified, adapted, combined and/or replaced, etc. in order to come to further embodiments of the invention.

In the following, advantageous embodiments of the invention will be described with respect to the enclosed drawings. However, neither the drawings nor the description shall be interpreted as limiting the invention.

The figures are only schematic representations and are not to scale. Same reference signs refer to same or similar features throughout the figures.

DETAILED DESCRIPTION

Figure 1:
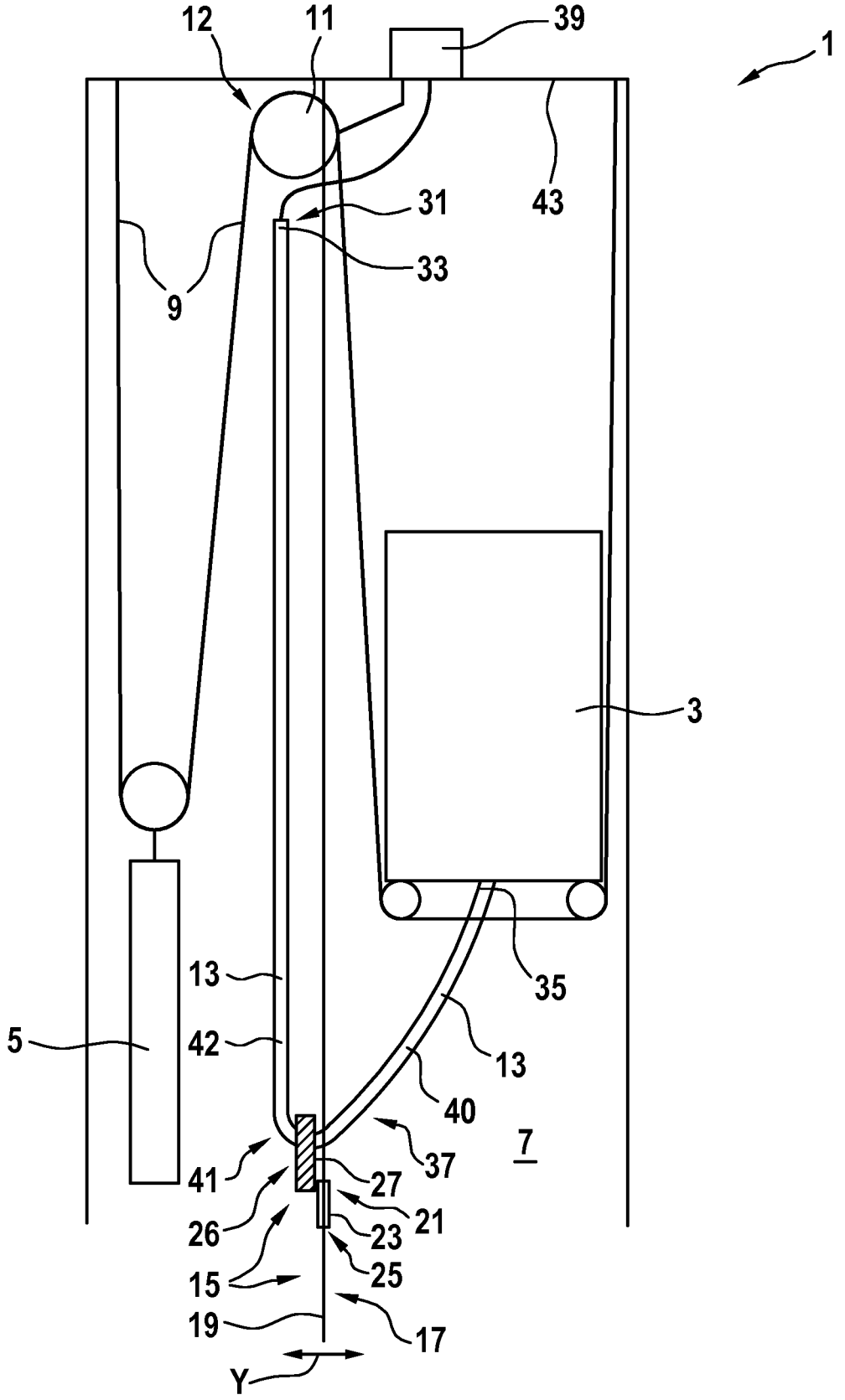
FIG. 1 shows an elevator system comprising a rope sway reducing arrangement according to an embodiment of the present invention.

FIG. 1 shows an elevator system 1 comprising two movable components such as an elevator car 3 and a counterweight 5 both being displaceable within a hoistway 7. The car 3 and the counterweight 5 are suspended and may be displaced using a suspension traction means 9 being driven by a traction sheave 11 of a driving engine 12.

Furthermore, the elevator system 1 comprises a rope-like means or device 13. The rope-like means may be any elongate means being bendable like a rope. For example, the rope-like means may be a rope, a belt, a cable, a wire or combinations of one or more such components.

One end 33 of the rope-like means 13 is attached to a fixed position 31 within the hoistway 7 and may be connected for example to a control unit 39 of the elevator system 1 controlling motions of the drive engine 12 and/or controlling functions of other components of the elevator system 1 such as functions of the elevator car 3. Furthermore, the rope-like means 13 may be connected to an electric power supply (not shown). An opposite end 35 of the rope-like means 13 is connected to the car 3 and may therefore move together with the car 3 throughout the hoistway 7.

As the rope-like means 13 is generally flexible in lateral directions, i.e. is bendable, and as furthermore the rope-like means 13 is only attached with its ends 33, 35 to components of the elevator system 1, an intermediate portion of the rope-like means 13 may generally be freely displaced within the hoistway 7. This is particularly true for a loosely hanging portion 37 of the rope-like means 13. Such loosely hanging portion 37 generally forms a generally U-shaped section 41 with one branch 40 being formed by a portion of the rope-like means 13 being attached to the car 3 and another branch 42 being formed by a portion of the rope-like means 13 being attached to the fixed position 31. Generally, this loosely hanging portion 37 is not mechanically tensioned except by its own weight and may therefore easily be moved within the hoistway 7. Particularly, this loosely hanging portion 37 may laterally sway within the hoistway 7 in a side direction, shown as x-direction (FIG. 2), and/or in forward/backward direction perpendicular to the side direction, shown as y-direction.

In order to limit such ability for lateral swaying of the rope-like means 13, the elevator system 1 further comprises a rope sway reducing arrangement 15. This RSR arrangement 15 comprises an elongate guide arrangement 17 and a rope tensioning arrangement 21. Therein, the RSR arrangement 15 is specifically adapted for generating forces onto the rope-like means 13 for mechanically tensioning the rope-like means 13 in a downward direction and, optionally, towards the guide arrangement 17 thereby reducing its ability for lateral swaying.

The elongate guide arrangement 17 is fixedly attached within the hoistway 7 and extends in its longitudinal vertical direction. The rope tensioning arrangement 21 comprises a weight member 25 and is mechanically connected to the guide arrangement 17 such that the rope tensioning arrangement 21 is displaceable along the longitudinal direction of the guide arrangement 17 and is guided by the guide arrangement 17 upon any vertical motion.

Furthermore, the rope tensioning arrangement 21 is mechanically connected to the rope-like means 13 in a lowermost loosely hanging portion 37 thereof, this lowermost portion 37 forming the U-shaped section 41. Due to such mechanical connection, the rope tensioning arrangement 21 may transmit tensioning forces 49 (FIG. 2) onto the rope-like means 13 which are generated due to the weight member 25 being drawn downwardly as a result of gravity.

Figure 2:
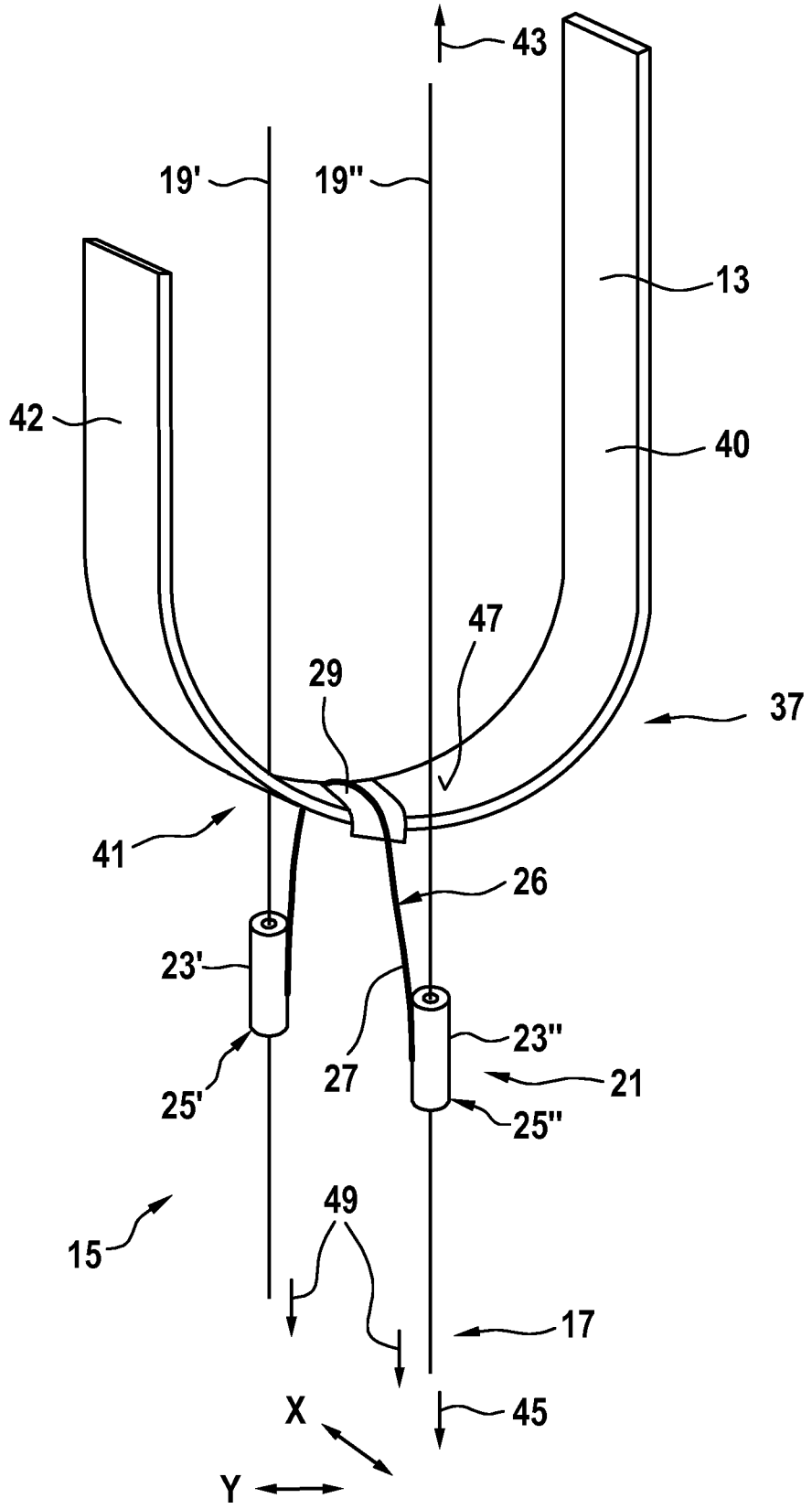
FIG. 2 shows details of a rope sway reducing arrangement according to an embodiment of the present invention.

As shown in more detail in FIG. 2, an exemplary embodiment of the rope sway reducing arrangement 15 comprises an elongate guide arrangement 17 formed by two parallel spanning ropes 19', 19" (19 in FIG. 1). These spanning ropes 19', 19" may be spanned between a top portion such as a roof 43 of the hoistway 7 and a bottom portion such as the bottom 45 of the hoistway 7. The two spanning ropes 19', 19" may be arranged in parallel to each other and with a sufficient spacing in x-direction to each such that the U-shaped section 41 at the lowermost loosely hanging portion 37 of the rope-like means 13 may be enclosed in between these two spanning ropes 19', 19". Accordingly, the two spanning ropes 19', 19" may already limit any sway of the rope-like means 13 in the sideways direction, i.e. in the x-direction.

In order to further limit such x-directed swaying and, particularly, in order to additionally limit any swaying in a forward/rearward direction, i.e. in the y-direction, the rope tensioning arrangement 21 further connects the U-shaped section 41 with the spanning ropes 19', 19" of the guide arrangement 17 and, furthermore, generates a downward-directed tensioning force 49 onto this U-shaped section 41.

For such purpose, the rope tensioning arrangement 21 comprises two ring members 23', 23" (23 in FIG. 1). each ring member 23', 23" being provided at one of the spanning ropes 19', 19" and enclosing this spanning rope 19', 19". In the example shown, the ring members 23', 23" are provided as cylindrical elements enclosing the spanning ropes 19', 19". Therein, each of the cylindrical ring members 23', 23" is provided with a substantial weight thereby integrally forming the weight members 25', 25" (25 in FIG. 1).

It may be mentioned that instead of forming the ring member 23 and the weight member 25 integrally as a single piece, such components may be provided as separate pieces being mechanically connected to each other.

In order to transmit the gravity-induced forces of the weight members 25', 25" to the rope-like element 13, an engagement member 26 formed by a rope-like connector 27 is provided. The rope-like connector 27 is connected at opposite ends to each of the ring members 23', 23" and weight members 25', 25". Intermediate to such opposite ends, the rope-like connector 27 engages with the rope-like means 13 in such a manner such as to enable transmitting the tensioning forces 49 onto the rope-like means 13.

In the example shown in FIG. 2, the rope-like connector 27 forms an engagement member 26 which engages behind an upward directed surface 47 of the lowermost portion of the U-shaped section 41.

During motion of the elevator car 3 within the hoistway 7, the lowermost U-shaped section 41 of the rope-like means 13 attached to the car 3 continuously moves throughout the hoistway 7 in its longitudinal direction. In other words, when the car 3 moves upwards, it will also pull the lowermost U-shaped portion 41 in an upward direction. However, due to the tensioning forces transmitted by the rope tensioning arrangement 15 to the U-shaped section 41, the rope-like member 13 stays always mechanically tensioned, a tensioning force 49 corresponding to the combined weight of the weight members 25', 25". On the one hand, such weight should not be too low in order to effectively limit any swaying of the loose portion 37 of the rope-like means 13. On the other hand, the weight should not be too heavy in order to not unnecessarily hinder the car's 3 motion. Typically, each of the weight members 25', 25" may have a weight of between 2 and 50 kg.

Furthermore, in order to protect, inter alia, a surface of the rope-like means 13 being in contact with the rope-like connector 27, a protection means 29 may be provided. Such protection means 29 may be interposed between the rope-like means 13 and the rope-like connector 27 such as to, inter alia, avoid any sharp edges and/or spread the tensioning forces 49 throughout an enlarged surface of the rope-like means 13. Thereby, the protection member 29 may prevent excessive wear both at the rope-like means 13 and at the rope-like connector 27.

Finally, it should be noted that the term "comprising" does not exclude other elements or steps and the "a" or "an" does not exclude a plurality. Also elements described in association with different embodiments may be combined.

In accordance with the provisions of the patent statutes, the present invention has been described in what is considered to represent its preferred embodiment. However, it should be noted that the invention can be practiced otherwise than as specifically illustrated and described without departing from its spirit or scope.

LIST OF REFERENCE SIGNS

1 elevator system
3 car
5 counterweight
7 hoistway
9 suspension traction member
11 traction sheave
12 drive engine
13 rope-like means
15 rope sway reducing arrangement
17 guide arrangement
19 spanning rope
21 rope tensioning arrangement
23 ring member
25 weight member
26 engagement member
27 rope-like connector
29 protection means
31 fixed position
33 one end of rope-like means
35 other end of rope-like means
37 loosely hanging portion of rope-like means
39 elevator control
40 first branch of U-shaped section
41 U-shaped section
42 second branch of U-shaped section
43 roof of hoistway
45 bottom of hoistway
47 upwards directed surface of U-shaped section
49 tensioning forces

The invention claimed is:

1. A rope sway reducing arrangement for hindering a lateral sway of an elongate rope-like device in a hoistway of an elevator system, one end of the rope-like device being attached to a movable component displaceable within the hoistway and another end of the rope-like device being attached to a fixed position within the hoistway, the arrangement comprising:

an elongate guide arrangement fixedly attached within the hoistway and extending in a longitudinal direction of the hoistway;

a rope tensioning arrangement including a weight member;

wherein the rope tensioning arrangement is mechanically connected to the guide arrangement and is displaceable along the longitudinal direction of the guide arrangement and is guided by the guide arrangement;

wherein the rope tensioning arrangement is mechanically connected to the rope-like device;

wherein the rope tensioning arrangement generates tensioning forces onto the rope-like device due to gravity-induced forces resulting from a weight of the weight member of the rope tensioning arrangement, the weight member being positioned below the rope-like device in the hoistway; and wherein the guide arrangement includes at least one spanning rope extending in the longitudinal direction between a top portion of the hoistway and a bottom portion of the hoistway.

2. The rope sway reducing arrangement according to claim 1 wherein the rope tensioning arrangement includes a ring member enclosing the at least one spanning rope to thereby guide the rope tensioning arrangement along the at least one spanning rope in the longitudinal direction.

3. The rope sway reducing arrangement according to claim 2 wherein the rope tensioning arrangement includes an engagement member mechanically connected to the ring member and engaging with the rope-like device to transmit the tensioning forces onto the rope-like device.

4. The rope sway reducing arrangement according to claim 3 wherein the engagement member engages an upwards directed surface of a lowermost portion of a U-shaped section of a loosely hanging portion of the rope-like device.

5. The rope sway reducing arrangement according to claim 1 wherein the guide arrangement includes two spanning ropes extending in parallel in the longitudinal direction between a top portion of the hoistway and a bottom portion of the hoistway.

6. The rope sway reducing arrangement according to claim 5 wherein the rope tensioning arrangement includes two ring members each enclosing one of the spanning ropes to thereby guide the rope tensioning arrangement along the spanning ropes in the longitudinal direction.

7. The rope sway reducing arrangement according to claim 6 wherein the rope tensioning arrangement includes an engagement member mechanically connected to the ring members and engaging with the rope-like device to transmit the tensioning forces onto the rope-like device.

8. The rope sway reducing arrangement according to claim 7 wherein the engagement member engages an upwards directed surface of a lowermost portion of a U-shaped section of a loosely hanging portion of the rope-like device.

9. The rope sway reducing arrangement according to claim 7 wherein the engagement member is a rope-like connector extending between the ring members.

10. The rope sway reducing arrangement according to claim 5 wherein one of the spanning ropes extends along a first lateral side of a loosely hanging portion of the rope-like device and another of the spanning ropes extends along a second lateral side of the loosely hanging portion of the rope-like device opposite to the first lateral side.

11. The rope sway reducing arrangement according to claim 1 wherein the weight member has a weight of between 4 kg and 100 kg.

12. The rope sway reducing arrangement according to claim 1 including a protection means protecting the rope-like device against wear upon engagement of a portion of the rope tensioning arrangement with the rope-like device.

13. An elevator system including the rope sway reducing arrangement according to claim 1 comprising:

the movable component displaceable within the hoistway of the elevator system;

the rope-like device having the one end of the rope-like device being attached to the movable component and the another end of the rope-like device being attached to the fixed position within the hoistway; and wherein the rope sway reducing arrangement is mechanically connected to the rope-like device.

14. A rope sway reducing arrangement for hindering a lateral sway of an elongate rope-like device in a hoistway of an elevator system, one end of the rope-like device being attached to a movable component displaceable within the hoistway and another end of the rope-like device being attached to a fixed position within the hoistway, the arrangement comprising:

an elongate guide arrangement fixedly attached within the hoistway and extending in a longitudinal direction of the hoistway;

a rope tensioning arrangement including a weight member;

wherein the rope tensioning arrangement is mechanically connected to the guide arrangement and is displaceable along the longitudinal direction of the guide arrangement and is guided by the guide arrangement;

wherein the rope tensioning arrangement is mechanically connected to the rope-like device;

wherein the rope tensioning arrangement generates tensioning forces onto the rope-like device due to gravity-induced forces resulting from a weight of the weight member of the rope tensioning arrangement;

wherein the guide arrangement includes two spanning ropes extending in parallel in the longitudinal direction between a top portion of the hoistway and a bottom portion of the hoistway;

wherein the rope tensioning arrangement includes two ring members each enclosing one of the spanning ropes to thereby guide the rope tensioning arrangement along the spanning ropes in the longitudinal direction;

wherein the rope tensioning arrangement includes an engagement member mechanically connected to the ring members and engaging with the rope-like device to transmit the tensioning forces onto the rope-like device;

wherein the engagement member engages an upwards directed surface of a lowermost portion of a U-shaped section of a loosely hanging portion of the rope-like device; and wherein the engagement member is a rope-like connector extending between the ring members.

15. A rope sway reducing arrangement for hindering a lateral sway of an elongate rope-like device in a hoistway of an elevator system, one end of the rope-like device being attached to a movable component displaceable within the hoistway and another end of the rope-like device being attached to a fixed position within the hoistway, the arrangement comprising:

an elongate guide arrangement fixedly attached within the hoistway and extending in a longitudinal direction of the hoistway;

a rope tensioning arrangement including a weight member;

wherein the rope tensioning arrangement is mechanically connected to the guide arrangement and is displaceable along the longitudinal direction of the guide arrangement and is guided by the guide arrangement;

wherein the rope tensioning arrangement is mechanically connected to the rope-like device;

wherein the rope tensioning arrangement generates tensioning forces onto the rope-like device due to gravity-induced forces resulting from a weight of the weight member of the rope tensioning arrangement;

wherein the guide arrangement includes at least one spanning rope extending in the longitudinal direction between a top portion of the hoistway and a bottom portion of the hoistway; and wherein the rope tensioning arrangement includes a ring member enclosing the at least one spanning rope to thereby guide the rope tensioning arrangement along the at least one spanning rope in the longitudinal direction.

* * * * *